US011202494B2

(12) United States Patent
Kawaguchi

(10) Patent No.: US 11,202,494 B2
(45) Date of Patent: Dec. 21, 2021

(54) HAMMOCK

(71) Applicant: Kiyoshi Kawaguchi, Kitakyuushuu (JP)

(72) Inventor: Kiyoshi Kawaguchi, Kitakyuushuu (JP)

( * ) Notice: Subject to any disclaimer, the term of this patent is extended or adjusted under 35 U.S.C. 154(b) by 45 days.

(21) Appl. No.: 16/766,772

(22) PCT Filed: Nov. 22, 2018

(86) PCT No.: PCT/JP2018/043262
§ 371 (c)(1),
(2) Date: May 26, 2020

(87) PCT Pub. No.: WO2019/107283
PCT Pub. Date: Jun. 6, 2019

(65) Prior Publication Data

US 2020/0315326 A1 Oct. 8, 2020

(30) Foreign Application Priority Data

Nov. 28, 2017 (JP) ..... JP2017-227908

(51) Int. Cl.
*A45F 3/22* (2006.01)

(52) U.S. Cl.
CPC ..... *A45F 3/22* (2013.01)

(58) Field of Classification Search
CPC ..... A45F 3/22
USPC ..... 5/120, 122
See application file for complete search history.

(56) References Cited

U.S. PATENT DOCUMENTS

2020/0315326 A1* 10/2020 Kawaguchi ..... A45F 3/22

FOREIGN PATENT DOCUMENTS

| | | | | |
|---|---|---|---|---|
| JP | S53-4316 Y2 | 2/1978 | | |
| JP | 2017196436 A | 11/2017 | | |
| WO | WO-2019107283 A1 * | 6/2019 | ..... | A45F 3/22 |
| WO | WO-2020241107 A1 * | 12/2020 | ..... | A45F 3/22 |

OTHER PUBLICATIONS

International Search Report dated Feb. 5, 2019 in PCT/JP2018/043262 (with English translation).

* cited by examiner

*Primary Examiner* — Robert G Santos
(74) *Attorney, Agent, or Firm* — Element IP, PLC

(57) ABSTRACT

With conventional cloth hammocks, when a person lies thereon and the fabric is pulled taut in the cloth-length direction, suitable elasticity cannot be achieved, leading to poor comfortability. According to the present invention, a forced crimping unit (11) forcibly produces crimping (wrinkles) to create suitable elasticity so that an impact on a human body by way of the movement is eased; and a design of adjusting level differences (32) thus produced to meet with the contours of the human body reduces variation in the weight distribution on the human body, thereby improving the comfortability. Moreover, a hooked clip (18), which is a component of the forced crimping unit (11), moves flexibly in response to the loading, thereby preventing damage to the cloth of the hammock and improving durability.

1 Claim, 11 Drawing Sheets

HAMMOCK

TECHNICAL FIELD

The present invention relates to a hammock that has incorporated a novel feature by adding novel fittings to improve comfortability of a fabric-made hammock.

BACKGROUND ART

Conventional fabric hammocks are described with reference to FIG. 1 and FIG. 2. FIG. 1 illustrates a typical fabric-made hammock with two support points. The upper drawing of FIG. 1 illustrates only the hammock, and the lower drawing illustrates a form of the hammock in use by a person lying thereon. FIG. 2 illustrates a simple fabric hammock with four support points that is disclosed in the Japanese Unexamined Patent Application, Publication No. 2017-196436. The upper drawing of FIG. 2 illustrates only the hammock, and the lower drawing illustrates a form of the hammock in use by a person lying thereon. The two-support point fabric-made hammock in FIG. 1 is coupled to two fixed suspension support points (3) via a pair of suspension ropes (2) respectively coupled to ends of a hammock body (1) to raise the hammock body (1) from the ground for a person to lie thereon. FIG. 3 illustrates a hammock body (1) of the four-support point simple fabric hammock according to FIG. 2. The hammock body (1) of the four-support point simple fabric hammock includes a pair of simple fabric hammock loops (5) made by folding and sewing each end of a rectangular base cloth (4). A pair of two-support point coupling chains (7) that are encased with protective hoses (6) are respectively inserted into the simple fabric hammock loops (5). Both ends of each of the two-support point coupling chains (7) are respectively coupled to the fixed suspension support points (3) to raise the hammock body (1) from the ground.

These hammocks (the two-support point fabric-made hammock and the four-support point simple fabric hammock) are the same in that they both use a base cloth (4) of a rectangular shape, in which the direction of height of a person lying on the hammock is referred to as a cloth-length direction (8) of the base cloth (4) and the direction of the width of the person lying on the hammock is referred to as a cloth-width direction (9) of the base cloth (4). The base cloth (4) is a cloth woven with the warp and the weft, with the warp running parallel with the cloth-length direction (8) and the weft running parallel with the cloth-width direction (9). These hammocks also are the same in that they both have crimping (wrinkles) that originates in coupling portions and extends in the cloth-length direction (8), and that the crimping (wrinkles) becomes smaller as they proceed toward the center of the base cloth (4) in the cloth-length direction (8). The coupling portions are where the base cloth (4) is coupled to mediums that respectively couple the hammock body (1) to the suspension support points (3) (the mediums being the suspension ropes (2) for the two-support point fabric-made hammock, and the two-support point coupling chains (7) and the protective hoses (6) for the four-support point simple fabric hammock); in other words, the coupling portions are both ends of the base cloth (4) in the cloth-length direction (8). The crimping (wrinkles) in the fabric-made hammocks (two-support point fabric-made hammock and the four-support point simple fabric hammock) is referred to as end crimping (10). When a person enters the hammock, the warp of the base cloth (4), which is coupled to the suspension support points (3) via the mediums, is pulled taut with the weight of the person. The weft of the base cloth (4), which is not directly coupled to the suspension support points (3), is not affected by the tension on the yarns resulting from the weight. Although the present invention may be applied either to the two-support point fabric-made hammock in FIG. 1 or to the four-support point simple fabric hammock in FIG. 2, the drawings of the four-support point simple fabric hammock in FIG. 2 are used to describe the present invention hereinafter.

PRIOR ART DOCUMENTS

Patent Documents

Patent Document 1: Japanese Unexamined Patent Application, Publication No. 2017-196436.

SUMMARY OF THE INVENTION

Problems to be Solved by the Invention

When a person lies on a firm, flat surface, he may feel discomfort as his weight is concentrated on convex parts along his contour. With a mattress filled with cotton, distribution and elasticity of the cotton cause the shape of the mattress to fit along the contour of his body, and thus reduce variation in the weight distribution on his body along his contour. The elasticity of the mattress also eases impact on his body when he moves while lying thereon. The foregoing effects of the mattress improve comfort of a person when he lies thereon. When a person lies on the conventional fabric-made hammock illustrated in FIG. 1 or FIG. 2, the base cloth (4) fits along the contour of his body in the cloth-width direction (9), so that the degree of his weight distribution is rather small in the cloth-width direction (9). However, the base cloth (4) is pulled taut in the cloth-length direction (8) with the tension resulting from his weight and thus does not fit along the contour of his body, so that the degree of his weight distribution is large in the cloth-length direction (8). In addition, although the end crimping (10) that exists in the conventional fabric-made hammocks on the both ends of the base cloth (4) in the cloth-length direction (8) has adequate elasticity itself and thus can contribute to improving the comfortability, the effect of the end crimping (10) is barely obtained because the end crimping (10) becomes smaller as it approaches the center portion of the hammock in the cloth-length direction (8), where weight of a person is applied the most.

The present invention improves comfortability of a fabric-made hammock by adding a novel mechanism to a conventional fabric-made hammock, the novel mechanism configured to reduce variation in weight distribution on a human body resulting from its convex and concave contour and add a reasonable level of elasticity.

Means for Solving the Problems

FIG. 4 includes three-plane drawings (plan view, bottom view, and right-side view) and the detail drawing A of a hammock according to an embodiment of the present invention. A forced crimping unit (11), which is a newly added fitting according to the embodiment of the present invention, is attached to the lower side of the fabric-made hammock. In the bottom view of FIG. 4, six pieces of the forced crimping units (11) are arranged in a row in a cloth-width direction (9) at approximately the center of a base cloth (4) in a cloth-length direction (8). A belt-like zone created by the forced crimping units (11), which are arranged in a row on the base cloth (4) in the cloth-width direction (9), is referred to as a forced crimping unit zone (12). The forced crimping unit (11), as illustrated in the detail drawing A in FIG. 4, is a fitting that pinches a portion of the base cloth (4) to forcibly produce crimping (a wrinkle). The crimping (wrinkle) is pinched by the forced crimping unit (11) so as to be directed in the cloth-length direction (8), and extends continuously forward and rearward the forced crimping unit (11) to a certain distance due to nature of fabric. A distance of the extension varies in accordance with such factors as how much the forced crimping unit (11) pinches the cloth, the type of fabric, and how much the hammock is pulled in the cloth-length direction (8). The plan view and the bottom view of FIG. 4 illustrate that the crimping (wrinkles) produced by the forced crimping units (11) extends beyond half the length of the base cloth (4) in the cloth-length direction (8). The bottom view and the right-side view in FIG. 4 illustrate six pieces of the forced crimping units (11) that produce six rows of narrow crimping (wrinkles) aligned on the base cloth (4) in parallel with the cloth-length direction (8).

A specific shape and a setting method of the forced crimping unit (11) are described with reference to FIGS. 5, 6, 7, 8, and 9. FIG. 5 illustrates a hammock body (1) of a four-support point simple fabric hammock according to FIG. 3, on which cloth-pinching wood pieces (13) are set. The cloth-pinching wood piece (13) is a rectangular wooden plate as illustrated in FIG. 6, with a clip-fixing notch (14) provided on one side of the rectangular wooden plate. The detail drawing A in FIG. 5 illustrates a forced crimping unit (11) portion in which two cloth-pinching wood pieces (13) are symmetrically set with respect to a cloth-folding centerline (15) that is parallel with the cloth-length direction (8), with the clip-fixing notches (14) directed outward. To form a forced crimping unit zone (12) constituted of a plurality of the forced crimping units (11), a plurality of pairs of the cloth-pinching wood pieces (13) illustrated in the detail drawing A in FIG. 5 are set in alignment with each other on the base cloth (4) so that a unit width centerline (17) perpendicular to the cloth-folding centerline (15) is aligned with a forced crimping unit zone centerline (16) drawn at any point on the base cloth (4) in the cloth-length direction (8). The distance between the each pair (Detail A in FIG. 5), that is, the distance between the each forced crimping unit (11) is optional. All the cloth-pinching wood pieces (13) are fixed to the base cloth (4) of the hammock with an adhesive.

FIG. 7 illustrates attachment of a hooked clip (18) made of metal that serves as a component of the forced crimping unit (11). The hooked clip (18) has a same configuration and operational principal as those of typical metal clips used for fixing documents and the like. As illustrated in the left-side drawings of FIG. 8, a sheet of rectangular metal plate is folded to form a U-shape constituted of a clip upper wall (19) and a pair of symmetric clip side walls (20) extending from ends of the clip upper wall (19), and the clip upper wall (19) and the clip side walls (20) respectively form acute angles therebetween so that the ends of the opposing right-and-left clip side walls (20) are in contact with each other. The hooked clip (18) is in a closed state when no tension exists as in the left-side drawings of FIG. 8. The opposing right-and-left clip side walls (20) can be opened by applying clip-opening force (21) outward each of the clip side walls (20) as illustrated in the right-side drawings of FIG. 8. Since elastic deformation of a metal plays a role in opening a hooked clip, the clip returns again to the closed state when the clip-opening force (21) becomes zero. Although a typical clip for holding documents and the like permits a possibility of the documents to be slipped off the clip, the hooked clip (18) according to the embodiment of the present invention includes fixing hooks (22) that are made by bending extremities of the right-and-left clip side walls (20) inward at a right angle for holding a material without being slipped off, and thus is different from the typical clip.

FIG. 7A illustrates a forced crimping unit (11) portion in a same condition as that of FIG. 5. FIG. 7C illustrates the forced crimping unit (11) in the condition following the condition of FIG. 7A, where the two cloth-pinching wood pieces (13) are layered with each other, with the base cloth (4) interposed therebetween. FIG. 7B is the hooked clip (18) in the open state as illustrated in FIG. 8. FIG. 7D illustrates the condition of one piece of the forced crimping unit (11) being completed after the hooked clip (18) in the open position as in FIG. 7B has been attached to the forced crimping unit (11) portion in the condition of FIG. 7C so as to embrace the two pieces of the cloth-pinching wood pieces (13), with the fixing hooks (22) being set and fixed to the clip-fixing notches (14).

A clip width (23) of the hooked clip (18) is defined to accommodate double the thickness (24) of the cloth-pinching wood piece (13) and double the thickness of the base cloth (4). A notch length (25) of the cloth-pinching wood piece (13) is made equal to a clip length (26) of the hooked clip (18). A height of the wood piece minus a notch width (27) of the cloth-pinching wood piece (13) is made equal to an internal height (28) of the hooked clip (18) so that the fixing hooks (22) of the hooked clip (18) fit tightly to a top face of the notch (29) of the cloth-pinching wood piece (13) without shifting. Furthermore, a hook width (30) of the hooked clip (18) is made smaller than a thickness (24) of the cloth-pinching wood piece (13) so that the fixing hook (22) does not protrude from the top face of the notch (29) of the cloth-pinching wood piece (13).

The attachment of the hooked clip (18) to the forced crimping unit (11) as illustrated in FIG. 7 is applied to all of the pairs of cloth-pinching wood pieces (13) (Detail A in FIG. 5) in the forced crimping unit (11) portions in FIG. 5, and thereby completes the hammock according to the embodiment of the present invention illustrated in FIG. 4. These are collectively illustrated in FIG. 9.

Effects of the Invention

FIG. 4 illustrates the hammock according to the embodiment of the present invention in a non-loaded state, in which no person lies thereon. By contrast, FIG. 10 illustrates the hammock according to the embodiment of the present invention in a loaded state, the load being applied in a same manner as when a person lies thereon. In FIG. 10, three-dimensional loading arrows (31) indicate presence of load. A person, which is the substance of the load, is not described for the purpose of depicting the state of the crimping (wrinkles) in the base cloth (4) because the person would otherwise obstruct the view of the base cloth (4) exhibiting its condition. In FIG. 4, the crimping (wrinkles) formed in the base cloth (4) in the cloth-length direction (8) extends across the entire hammock, but FIG. 10 illustrates that the crimping (wrinkles) in the base cloth (4) in the cloth-length direction (8) disappears in the areas excluding the vicinity of the end crimping (10) and the forced crimping unit zone (12) in the base cloth (4) according to the embodiment of the present invention. This indicates that the crimping (wrinkles) formed in the base cloth (4) in the cloth-length direction (8), as seen in FIG. 4, is extended by a human body in the areas excluding the forced crimping unit zone (12), in which the crimping (wrinkles) is forcibly produced, and the coupling portions, in which the base cloth (4) is coupled to the two-support point coupling chains (7). When the person gets off the hammock and the hammock returns to the non-loaded state again, the crimping (wrinkles) regains their original condition illustrated in FIG. 4, in which the crimping (wrinkles) has elasticity, while it may be affected by some factors such as the type of the fabric, the time of loading, the environment (temperature, humidity) around the base cloth (4), and the pulling force on the base cloth (4) in the cloth-length direction (8). Although the elasticity of the crimping (wrinkles) is small in the non-loaded state, the elasticity of the crimping (wrinkles) increases in a human loading state as the pulling force on the base cloth (4) in the cloth-length direction (8) increases. Consequently, adequate elasticity is applied to the person's body, easing impact on his body when he moves while lying thereon, thereby improving his comfort.

With the conventional hammock, the warp of the base cloth (4) in the cloth-length direction (8) is pulled taut in the loaded state under which the hammock shape does not fit along the contour of a person's body, and the load is concentrated on the buttocks, which are the most convex points of human body's contour, and thus comfortability is deteriorated. FIG. 11 is a side elevation of the hammock according to the embodiment of the present invention with a person lying thereon. This drawing depicts a level difference (32) between the forced crimping unit zone (12) portion and each side thereof. This is because while the crimping (wrinkles) in the forced crimping unit zone (12) portion changes little in response to loading, the crimping (wrinkles) in other areas is extended in response to human loading and sags the hammock. By adjusting the size of the forced crimping unit (11) to fit the level difference (32) with a level difference of a human body between the buttocks and the waist, the load concentrated on the buttocks can be spread out to the waist, and thus comfortability is improved.

To forcibly producing crimping (wrinkles), the cloth can be folded and layered to attach directly to each other by sewing or with an adhesive. However, when a load is applied, the load would be concentrated on some parts of the cloth, and thus damages the cloth. With the hammock according to the embodiment of the present invention, the hooked clip (18) opens and closes flexibly in response to the loading, spreading out the load on the cloth, thereby improving durability of the base cloth (4) against the use of the hammock. The fixing hooks (22) of the hooked clip (18) are made to fit tightly to the top faces of the notches (29) of the cloth-pinching wood pieces (13) so that the fixing hooks (22) of the hooked clip (18) do not shift and damage the cloth with their corners.

DESCRIPTION OF EMBODIMENTS

Figure 1:
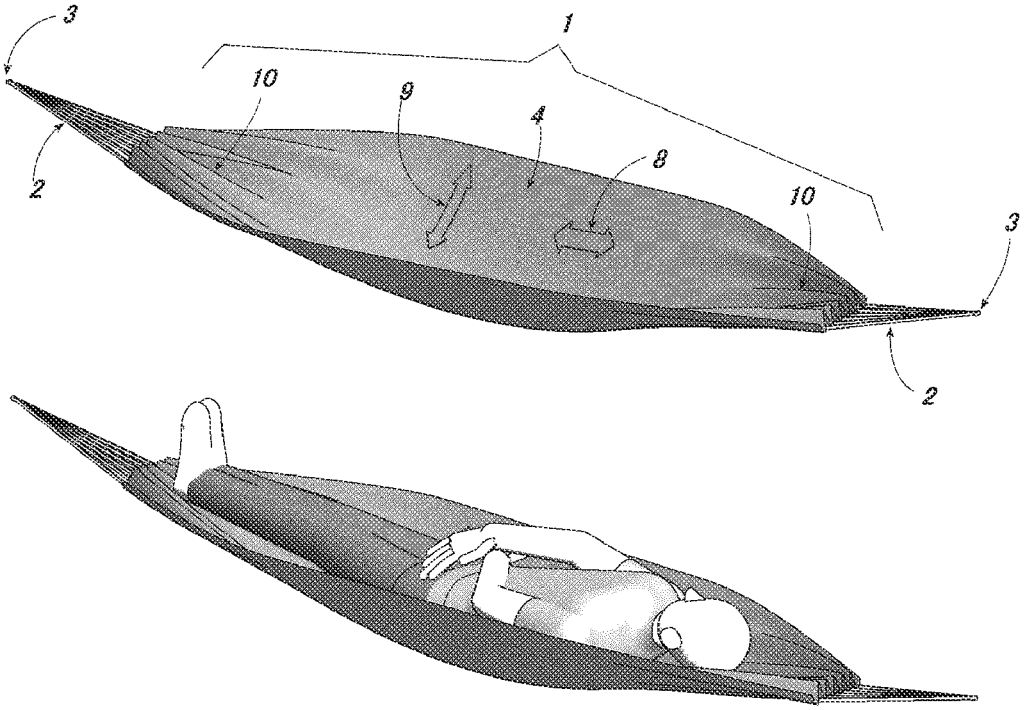
Prior Art FIG. 1
FIG. 1 illustrates a conventional two-support point fabric-made hammock.
Figure 2:
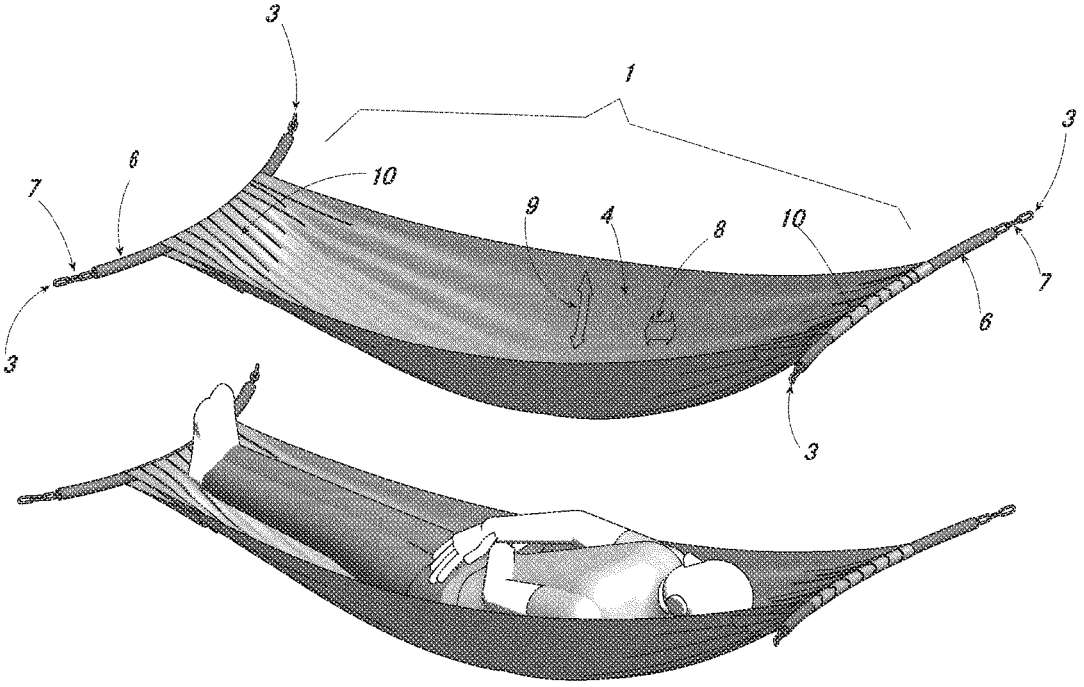
Prior Art FIG. 2
FIG. 2 illustrates a four-support point simple fabric hammock (Japanese Unexamined Patent Application, Publication No. 2017-196436).
Figure 3:
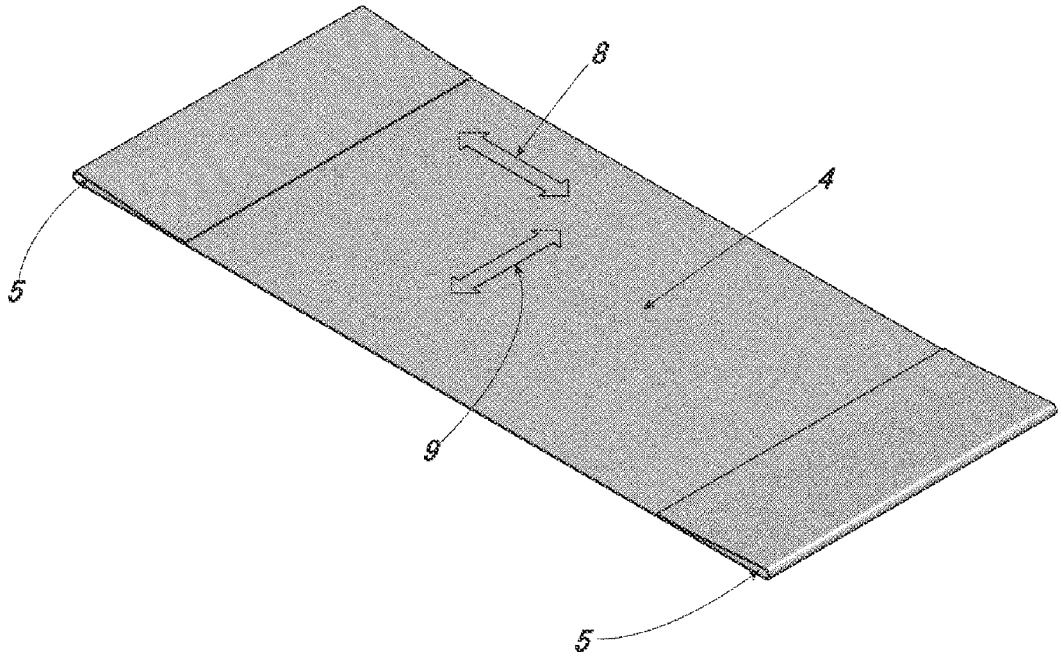
Prior Art FIG. 3
FIG. 3 illustrates a hammock body of the four-support point simple fabric hammock (Japanese Unexamined Patent Application, Publication No. 2017-196436).
Figure 4:
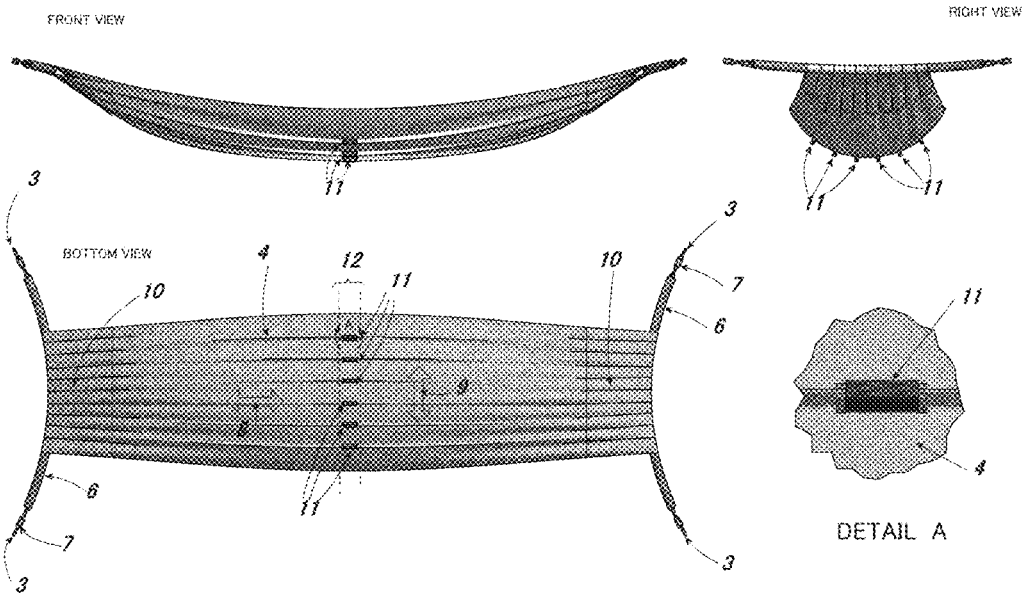
FIG. 4 illustrates a hammock according to an embodiment of the present invention (non-loaded).
Figure 5:
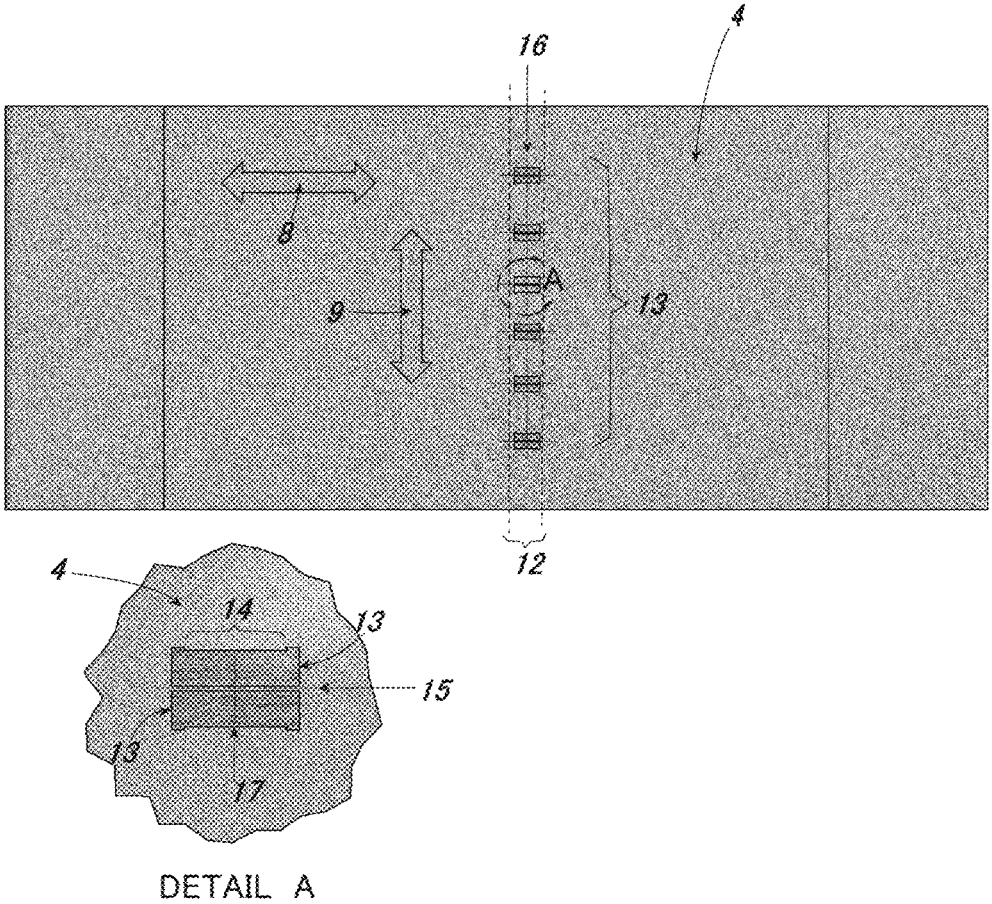
FIG. 5 illustrates cloth-pinching wood pieces set on the base cloth of the four-support point simple fabric hammock.
Figure 6:
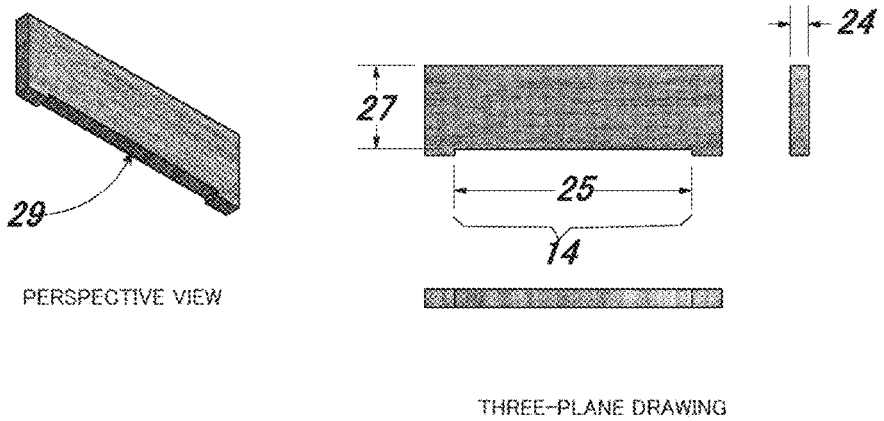
FIG. 6 illustrates a cloth-pinching wood piece.
Figure 7:
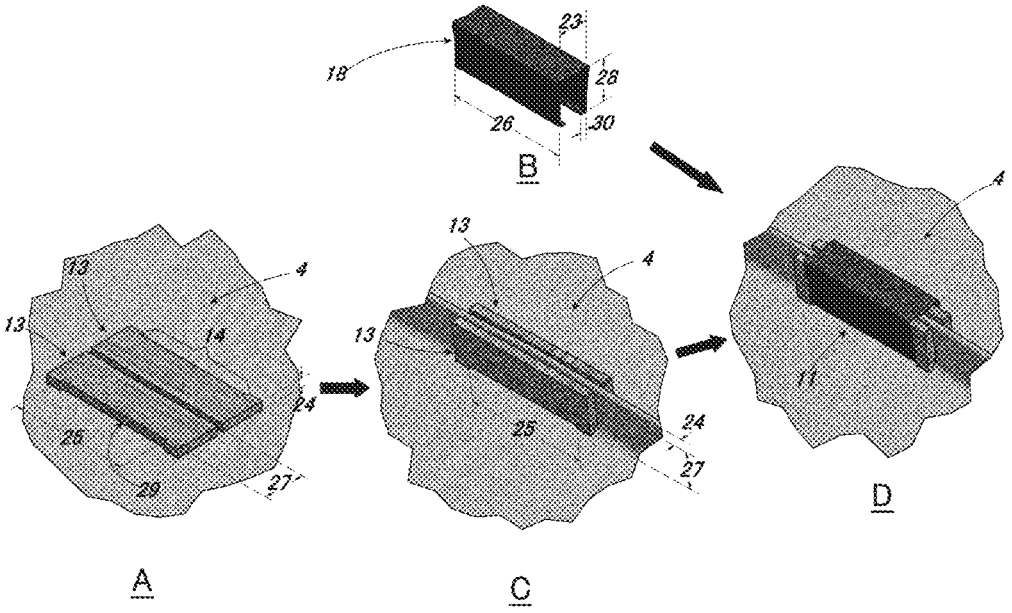
FIG. 7 illustrates attachment of a hooked clip (to one piece of the forced crimping unit).
Figure 8:
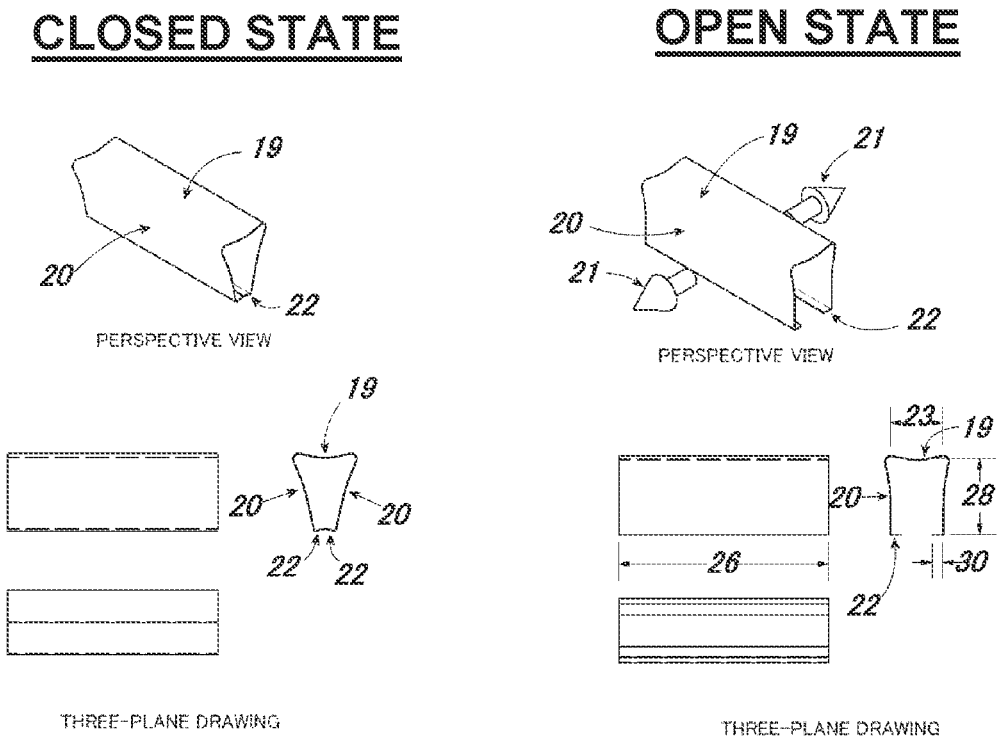
FIG. 8 illustrates operations of the hooked clip.
Figure 9:
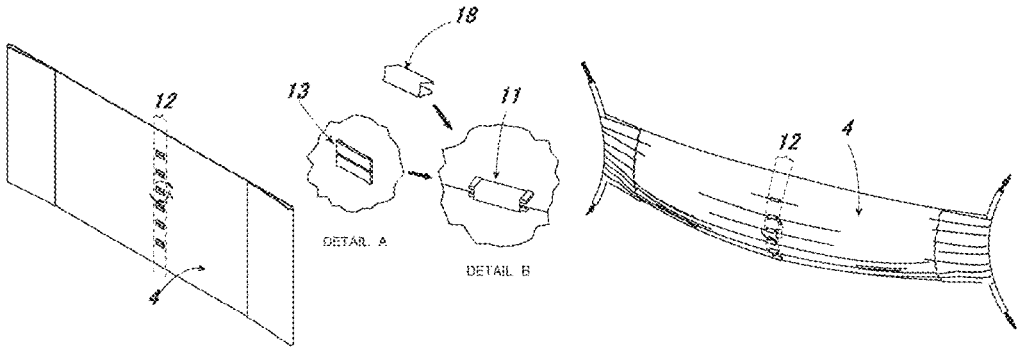
FIG. 9 illustrates attachment of the hooked clips (to the entire hammock).
Figure 10:
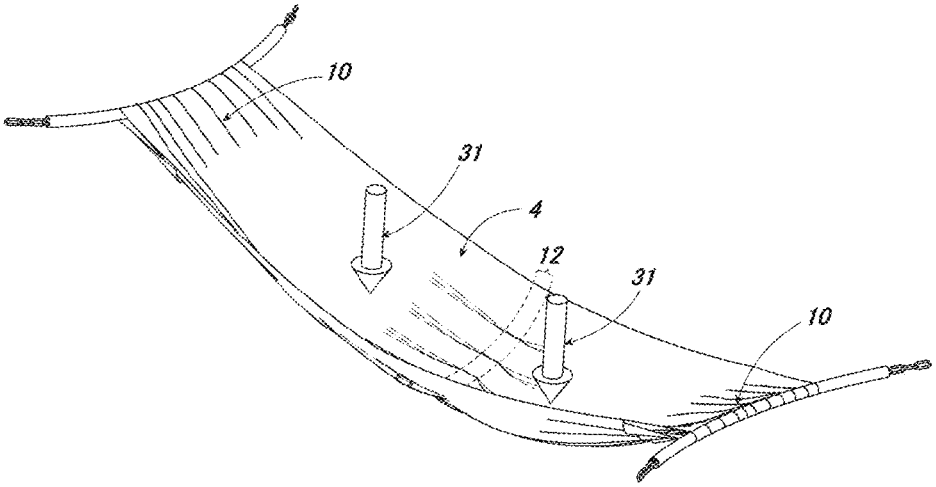
FIG. 10 illustrates the hammock according to the embodiment of the present invention in a loaded state.

As described above, the embodiment of the present invention can be applied to the typical two-support point fabric-made hammock in FIG. 1, the four-support point simple fabric hammock in FIG. 2, and the like. The characteristics of these hammocks are that the hammock body (1) is made of fabric, and that the hammocks have the crimping (wrinkles) (end crimping (10)) that originates in the coupling portions, in which the base cloth (4) is coupled to the mediums that respectively couple the hammock body (1) to the suspension support points (3) (the mediums being the suspension ropes (2) for the two-support point fabric-made hammock, and the two-support point coupling chains (7) and the protective hoses (6) for the four-support point simple fabric hammock), that is, the both ends of the base cloth (4) in the cloth-length direction (8).

The size and the quantity of the forced crimping units (11) and the interval therebetween in the forced crimping unit zone (12) are optional. The hammock shape in the lateral width direction is to be designed by adjusting these figures to improve comfort of a person lying on the hammock.

Figure 11:
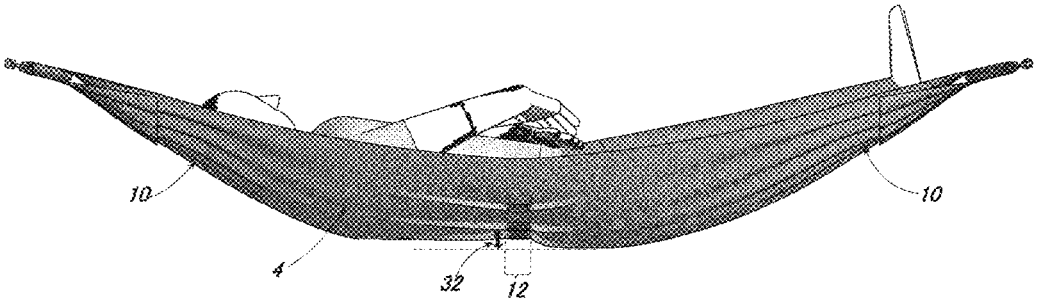
FIG. 11 illustrates a side elevation of the hammock according to the embodiment of the present invention with a person lying thereon.

FIG. 11 illustrates an example in which the forced crimping unit zone (12) is applied to the waist portion, but the forced crimping unit zone (12) can also be adapted to another portion of the hammock where a recessed body part (such as the neck) of a person is situated when he lies thereon.

REFERENCE SIGNS LIST

4 base cloth
8 cloth-length direction
9 cloth-width direction
11 forced crimping unit
12 forced crimping unit zone
13 cloth-pinching wood piece
14 clip-fixing notch
15 cloth-folding centerline
18 hooked clip
19 clip upper wall
20 clip side wall
21 clip-opening force
22 fixing hook
29 top face of the notch
32 level difference

The invention claimed is:

1. A fabric-made hammock that forcibly produces crimping, comprising:

a fabric-made hammock having a base cloth in a rectangular shape with a cloth-length direction and a cloth-width direction, and one or a plurality of forced crimping units for forcibly producing crimping in the base cloth, each forced crimping unit constituted of two cloth-pinching wood pieces of an identical shape and a hooked clip, the cloth-pinching wood pieces each being a rectangular wooden plate with a clip-fixing notch provided on one side of the rectangular wooden plate, the hooked clip comprising a folded a sheet of rectangular metal plate forming a U-shape constituted of a clip upper wall and a pair of symmetric clip side walls extending from ends of the clip upper wall, being in a closed state, with the clip upper wall and each of the clip side walls forming an acute angle therebetween so that ends of the opposing clip side walls are in contact with each other, allowing the opposing clip side walls to be in an open state when a clip-opening force is applied outward to each of the opposing clip side walls, and having fixing hooks comprising bent extremities of the opposing clip side walls inward at a right angle, the two cloth-pinching wood pieces in each forced crimping unit being fixed to the base cloth with an adhesive so as to be arranged symmetrically with respect to a cloth-folding centerline that is parallel with the cloth-length direction with the clip-fixing notch directed outward, being layered with each other, with the base cloth interposed therebetween, and being attached with the hooked clip in an open state so as to be embraced by the hooked clip, with the fixing hook of the hooked clip tightly fitted to a top face of the clip-fixing notch so that the fixing hook of the hooked clip does not shift on the top face of the clip-fixing notch, thereby arranging each forced crimping unit to form a piece of crimping in the base cloth in parallel with the cloth-length direction, wherein the one or a plurality of the forced crimping units are arranged on the base cloth at an optional interval on a straight line in parallel with the cloth-width direction to form a forced crimping unit zone in which the crimping is formed in the base cloth in parallel with the cloth-length direction in a number corresponding to the number of the forced crimping units, and wherein elastic deformation plays a role in an opening and closing operation of the clip side walls of each hooked clip being made of metal when the hammock is in use.

* * * * *